US006289535B1

(12) United States Patent
Hernandez

(10) Patent No.: US 6,289,535 B1
(45) Date of Patent: Sep. 18, 2001

(54) MATTRESS SUPPORT AND METHOD

(75) Inventor: Carlos J. Hernandez, Greensboro, NC (US)

(73) Assignee: United Finishers, Inc., High Point, NC (US)

( * ) Notice: Subject to any disclaimer, the term of this patent is extended or adjusted under 35 U.S.C. 154(b) by 0 days.

(21) Appl. No.: 09/480,617

(22) Filed: Jan. 10, 2000

Related U.S. Application Data

(63) Continuation-in-part of application No. 09/301,242, filed on Apr. 28, 1999, now Pat. No. 6,134,728.

(51) Int. Cl.[7] ..... A47C 19/04

(52) U.S. Cl. ..... 5/200.1; 5/185; 5/176.1; 5/202

(58) Field of Search ..... 5/174, 175, 176.1, 5/181, 185, 200.1, 201, 202, 236.1, 238

(56) References Cited

U.S. PATENT DOCUMENTS

| | | | | |
|---|---|---|---|---|
| 586,550 | * | 7/1897 | Foster . | |
| 587,864 | * | 8/1897 | Ryan et al. . | |
| 674,725 | * | 5/1901 | Bergman et al. . | |
| 697,102 | * | 4/1902 | Pack . | |
| 779,622 | * | 1/1905 | Pieper . | |
| 819,631 | * | 5/1906 | Bollinger . | |
| 934,607 | * | 9/1909 | Grenier . | |
| 985,355 | * | 2/1911 | Lockhart . | |
| 1,319,576 | * | 10/1919 | Durden . | |
| 1,504,807 | * | 8/1924 | Brotherton, Jr. et al. . | |
| 1,640,754 | * | 8/1927 | Covey . | |
| 1,676,987 | * | 7/1928 | Line . | |
| 1,716,243 | * | 6/1929 | Rooks . | |
| 2,452,808 | * | 11/1948 | Tucker . | |
| 2,550,224 | * | 4/1951 | Clerc . | |
| 2,624,890 | * | 1/1953 | Rubinstein . | |
| 2,674,749 | * | 4/1954 | Longnecker | 5/181 |
| 2,676,339 | * | 4/1954 | Collins . | |
| 2,886,832 | * | 5/1959 | Mitchell et al. . | |
| 2,900,647 | * | 8/1959 | Sands . | |
| 3,003,158 | * | 10/1961 | Sevcik | 5/176.1 |
| 3,646,623 | * | 3/1972 | Harris et al. . | |
| 3,736,602 | * | 6/1973 | Miller | 5/176.1 |
| 3,744,066 | * | 7/1973 | Falivene | 5/176.1 |
| 3,761,970 | | 10/1973 | Fredman | 5/181 |
| 3,842,451 | * | 10/1974 | McCormick | 5/200 |
| 3,881,202 | * | 5/1975 | Tyhanic | 5/176.1 |
| 3,984,884 | | 10/1976 | Spitz | 5/202 |
| 3,999,231 | * | 12/1976 | Robins | 5/176.1 |
| 4,019,211 | | 4/1977 | Spitz | 5/181 |
| 4,027,343 | | 6/1977 | Hooker . | |
| 4,038,710 | | 8/1977 | Tambascio | 5/200 |
| 4,070,717 | | 1/1978 | Kitchen et al. | 5/176 |
| 4,535,494 | * | 8/1985 | Diamonstein | 5/400 |
| 4,704,751 | * | 11/1987 | Guerra | 5/236 |
| 5,203,039 | * | 4/1993 | Fredman | 5/203 |
| 5,815,860 | * | 10/1998 | Mitchell | 5/236 |

OTHER PUBLICATIONS

Leggett & Platt Steel Products Division Branch Price List eff. Date Jan. 30, 1995.
K31 Assembly Instructions–undated.

* cited by examiner

*Primary Examiner*—Michael F. Trettel

(57) ABSTRACT

X and v-shaped mattress supports comprise a pair of pivotal longitudinal members for replacing conventional wooden slats. Each terminal end of each longitudinal member includes a flange for attachment to the side rails of a conventional bed frame. An extendable leg provides additional support for the center of the slat. The method of use consists of pivoting the longitudinal members of the mattress support to accommodate the particular width of the side rails of the selected bed frame. In one alternate embodiment a pair of v-shaped mattress support slats are connected by a divider for containing a pair of mattresses in side-by-side form.

5 Claims, 12 Drawing Sheets

MATTRESS SUPPORT AND METHOD

This is a continuation-in-part of patent application Ser. No. 09/301,242 filed Apr. 28, 1999, now U.S. Pat. No. 6,134,728.

FIELD OF THE INVENTION

This invention pertains to x-shaped and v-shaped supports for extending between the two side rails of a conventional bed frame for supporting mattresses and/or box springs placed thereon.

DESCRIPTION OF THE PRIOR ART AND OBJECTIVES OF THE INVENTION

While normal beds typically have two parallel side rails and wooden slats extending therebetween to support mattresses and box springs, this arrangement may lead to instability at the ends where the box springs are not supported by the wooden slats. Likewise, in the increasingly popular Hollywood frames, both ends of the box springs are similarly unsupported.

In an attempt to address this potential instability, it is a purpose of the present invention to provide a mattress support which comprises a rigid, pivotal structure, whereby the arcuate pivoting action allows for adjustable positioning for bed frames of various widths.

It is a further objective of the present invention to provide a mattress support which has an extension to accommodate large distances between side rails as with California king size and other king size bed frames.

It is still a further objective of the present invention to provide a rigid, adjustable mattress support and method which incorporates a height adjustable central leg to support the crossing of the x or v-shaped support or slat against the floor or other surface below.

These and other objectives and advantages will become readily apparent to those skilled in the art upon reference to the following detailed description and accompanying drawing figures.

SUMMARY OF THE INVENTION

The aforedescribed objectives and advantages are realized by providing in one embodiment two longitudinal members of equal length formed from angle iron which are connected to cooperate in a scissor-like motion to form an x-shaped mattress support or slat when seen in top plan view. Terminal ends of each longitudinal member include a flange to rest on the bed frame side rails. Each flange may include a hole therethrough for rigid affixation to the side rails if desired. The top longitudinal member includes a slot in its downward depending portion proximate the center of its length. Pivotally positioned in this slot is the second or bottom longitudinal member. A conventional bolt or screw allows the two longitudinal members to pivot relative to one another to effectuate the scissor-like motion desired. The slot approximately levels the upper surfaces of the two longitudinal members.

In alternate configuration of the first embodiment described above, a central adjustable leg, as is conventional may be used to support the center of the x-shaped bed support. Likewise, it is foreseen using a plurality of x-shaped longitudinal members between two side rails to properly support a bed of unusual length. In still another configuration, one x-shaped slat includes selectively extendable extensions which allow the longitudinal members to conveniently extend between two side rails for a bed of unusual width such as a California king size bed.

In a second embodiment of the invention a pivotal slat having a V-shape when seen in top plan view, is provided having two longitudinal members of equal length, also formed of angle iron with a flat, upper portion and a downwardly depending portion along each longitudinal member of the "v". A vertical, adjustable leg is affixed at the intersection of the "v" for additional support. Each longitudinal member of the "v" can arcuately pivot for ease in placement on beds of different widths from approximately 35.5 inches (90 cm) in width to about 78 inches (198 cm).

In still another embodiment of the invention a pair of v-shaped pivotal slats are connected with a divider for supporting a pair of mattresses in side by side configuration.

DETAILED DESCRIPTION OF THE PREFERRED EMBODIMENT AND OPERATION OF THE INVENTION

Figure 1:
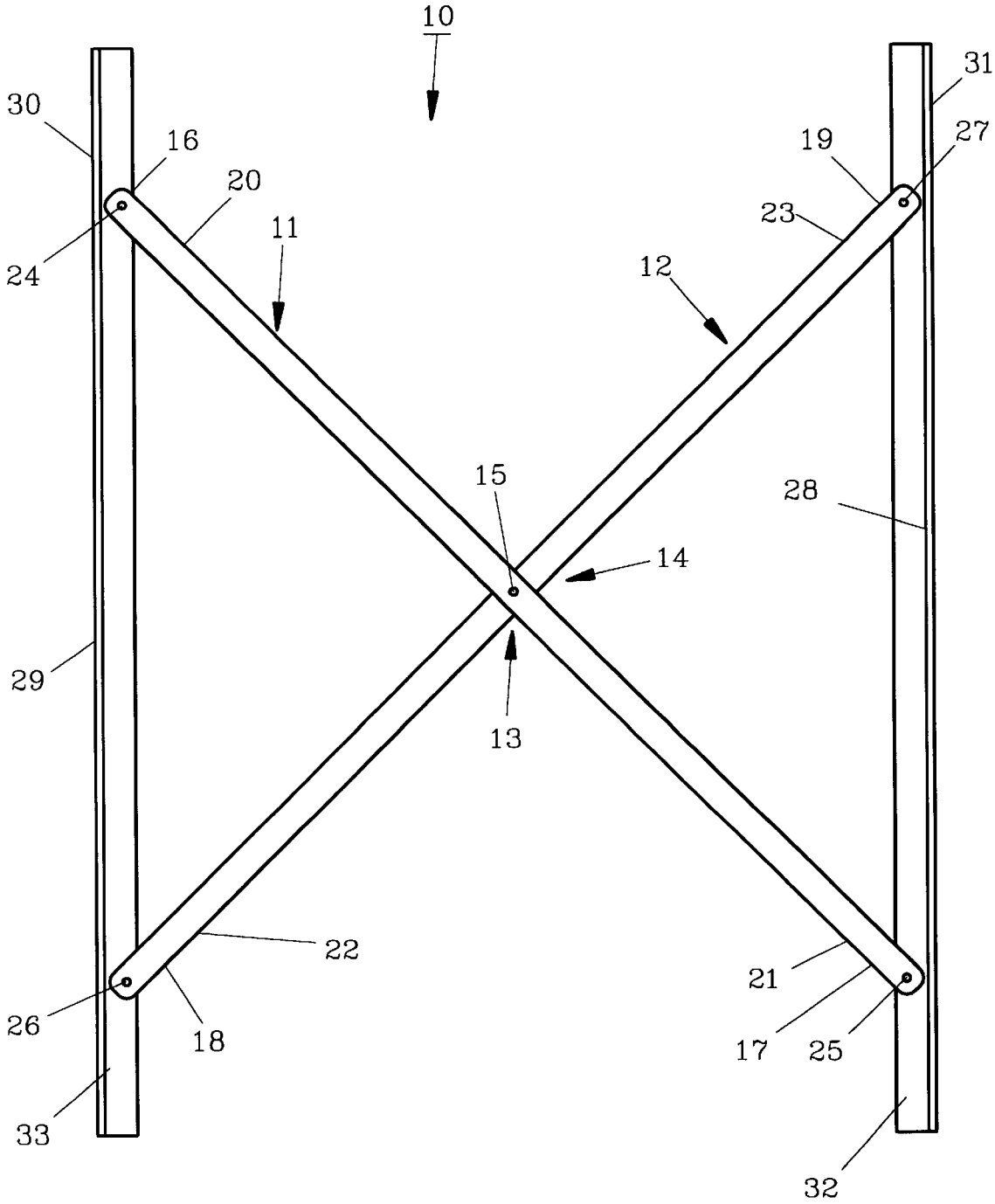
FIG. 1 shows a top view of the preferred embodiment of the present invention as used between two side rails of a bed.

Turning now to the drawings, specifically FIG. 1 shows preferred mattress support 10 which comprises first or top longitudinal member 11 and second or bottom longitudinal member 12 joined proximate center points 13 and 14 respectively by conventional threaded fastener 15. Longitudinal members 11 and 12 are preferably formed from conventional angle iron. At terminal ends 16–19 are flanges 20–23 (see also FIG. 2) which define holes 24–27 respectively. Holes 24–27 may be used with conventional fasteners (not shown) to more rigidly affix mattress support 10 to side rails 28 and 29 of a typical bed frame. In the preferred method, mattress support 10 is pivoted into a suitable x-shaped width (in top plan view) and extends between standard bed side rails 28 and 29, thus providing support proximate corners 30–33 to a conventional box spring (not shown).

Figure 2:
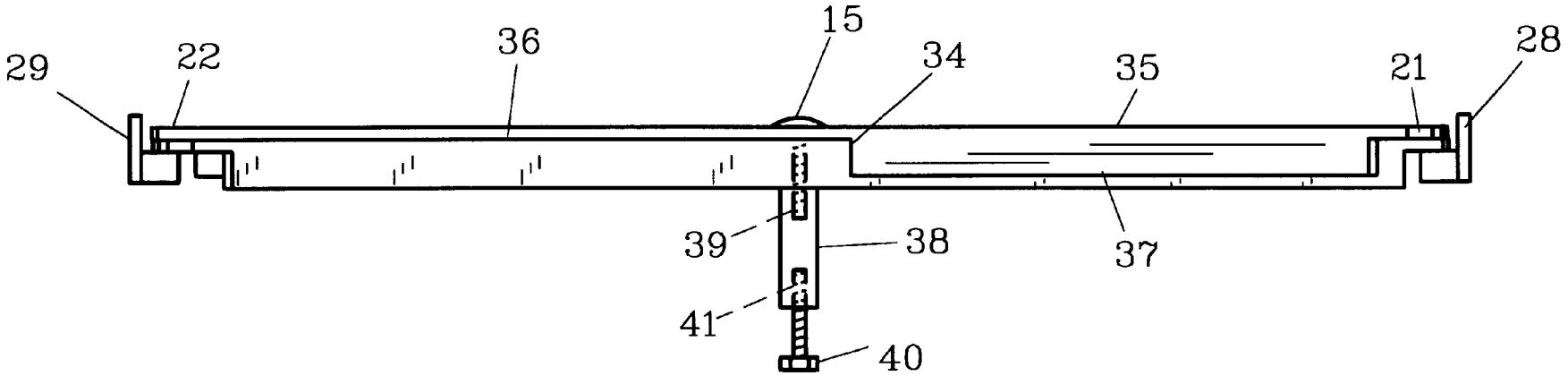
FIG. 2 illustrates an end view of the device of FIG. 1 with an optional support leg attached.

As seen in FIG. 2, top longitudinal member 11 includes slot 34 (see also FIG. 3) in depending portion 37 which bottom longitudinal member 12 fits within to level top surfaces 35 and 36 of longitudinal members 11 and 12 respectively. The opposite end view is a mirror image thereof. Fastener 15 may be a bolt and attach to optional support leg 38 by means of threaded channel 39. Threaded foot 40 may be positioned in threaded channel 41 to extend the length of foot 40 as needed.

Figure 3:
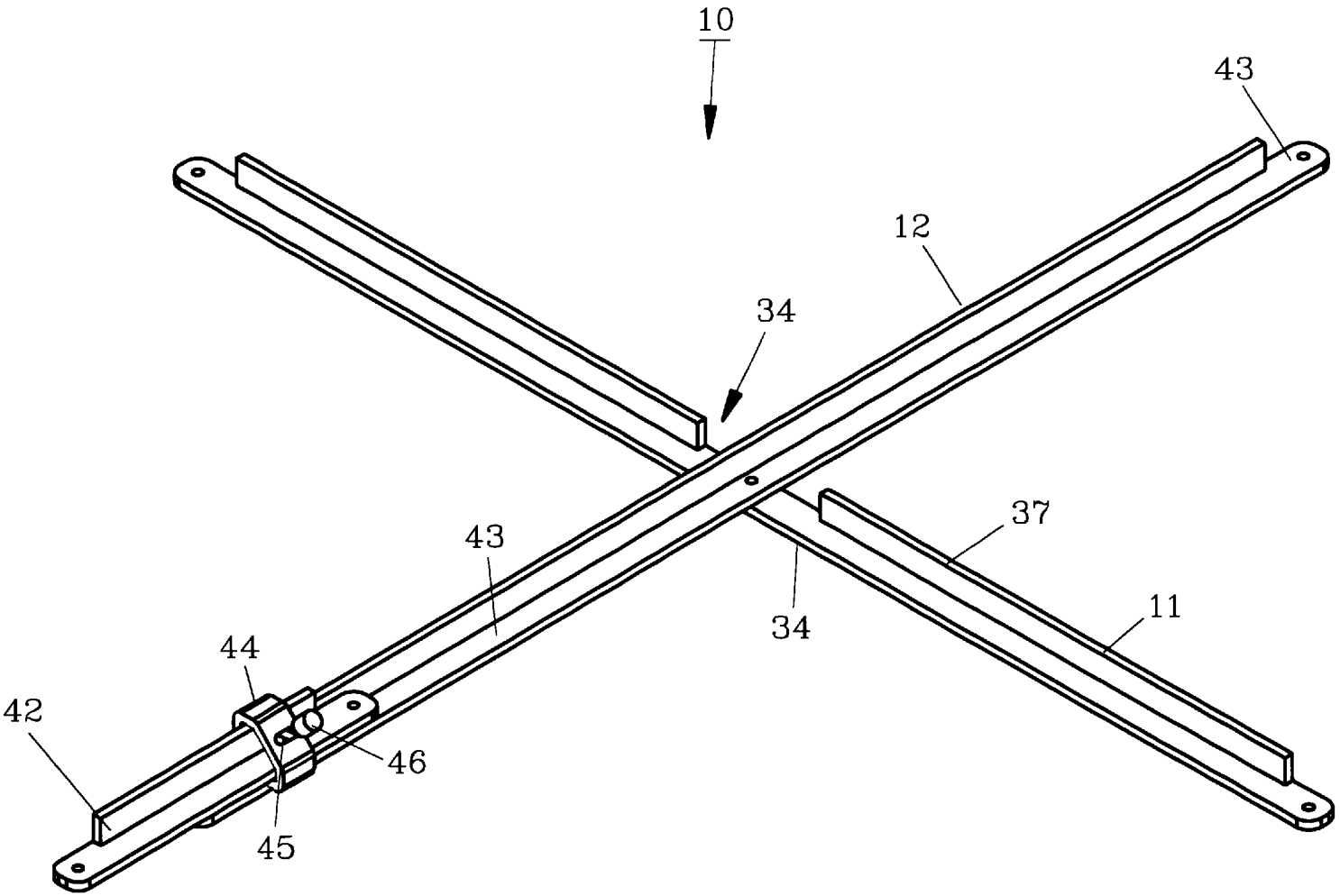
FIG. 3 (shown inverted) demonstrates one of the longitudinal members of the device of FIG. 1 with an optional extension member attached.

In FIG. 3, seen without leg 38, longitudinal member 11 may include extension member 42, which is preferably formed of angle iron. Attaching device 44 is conventional as is commonly found on Hollywood bed frames and includes an open triangular shaped body with threaded aperture 45 and threaded fastener 46 passing therethrough. The fastener is tightened against extension 42 forcing it into tight frictional engagement with undersurface 43 of longitudinal member 12. This arrangement is well suited for use with exceptionally wide beds.

Figure 4:
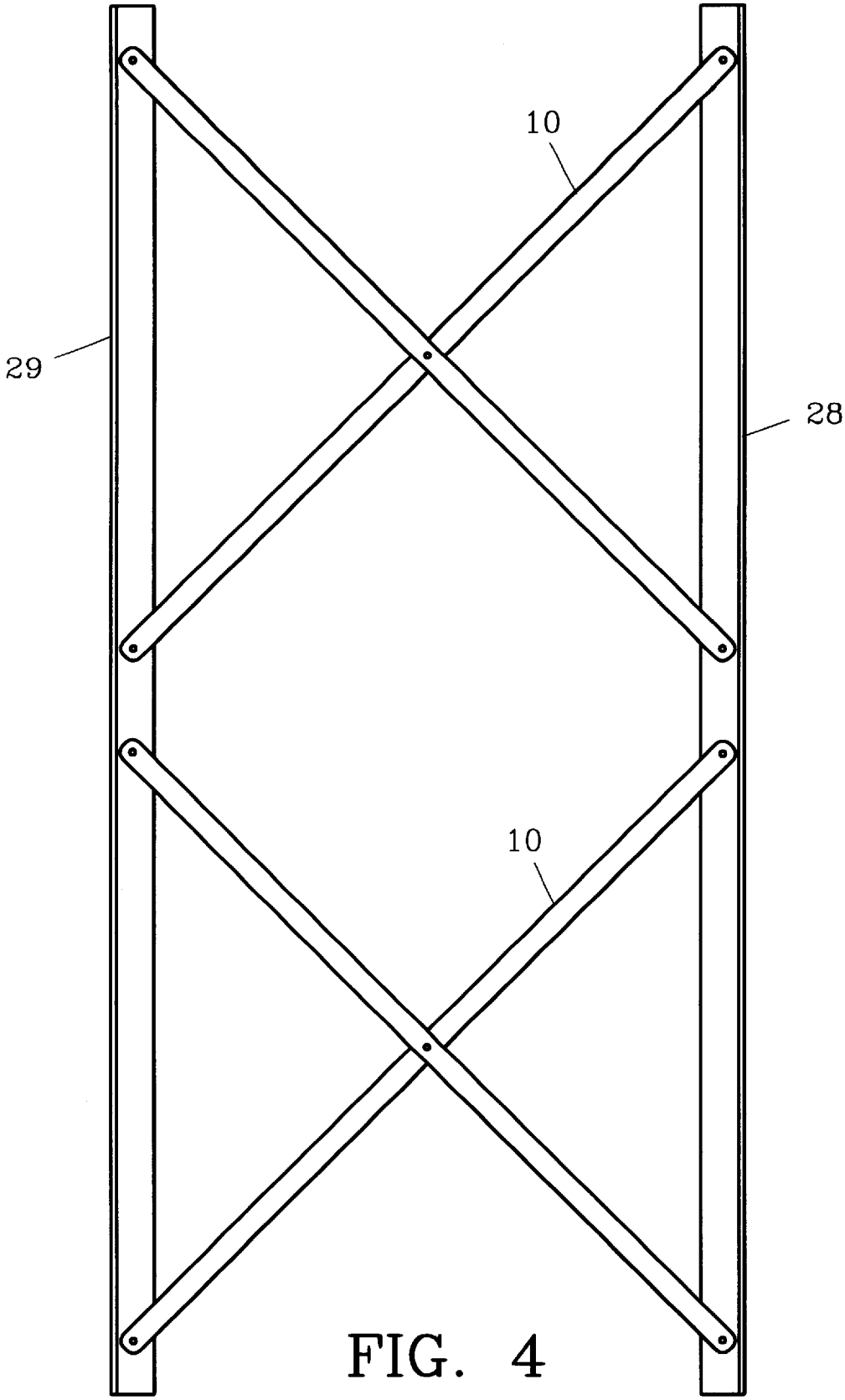
FIG. 4 features an alternate combination of bed frame rails and a plurality of x-shaped mattress supports.

FIG. 4 shows a plurality of mattress supports 10 as may be used to support a box spring (not shown) on a bed frame of unusual length.

Figure 5:
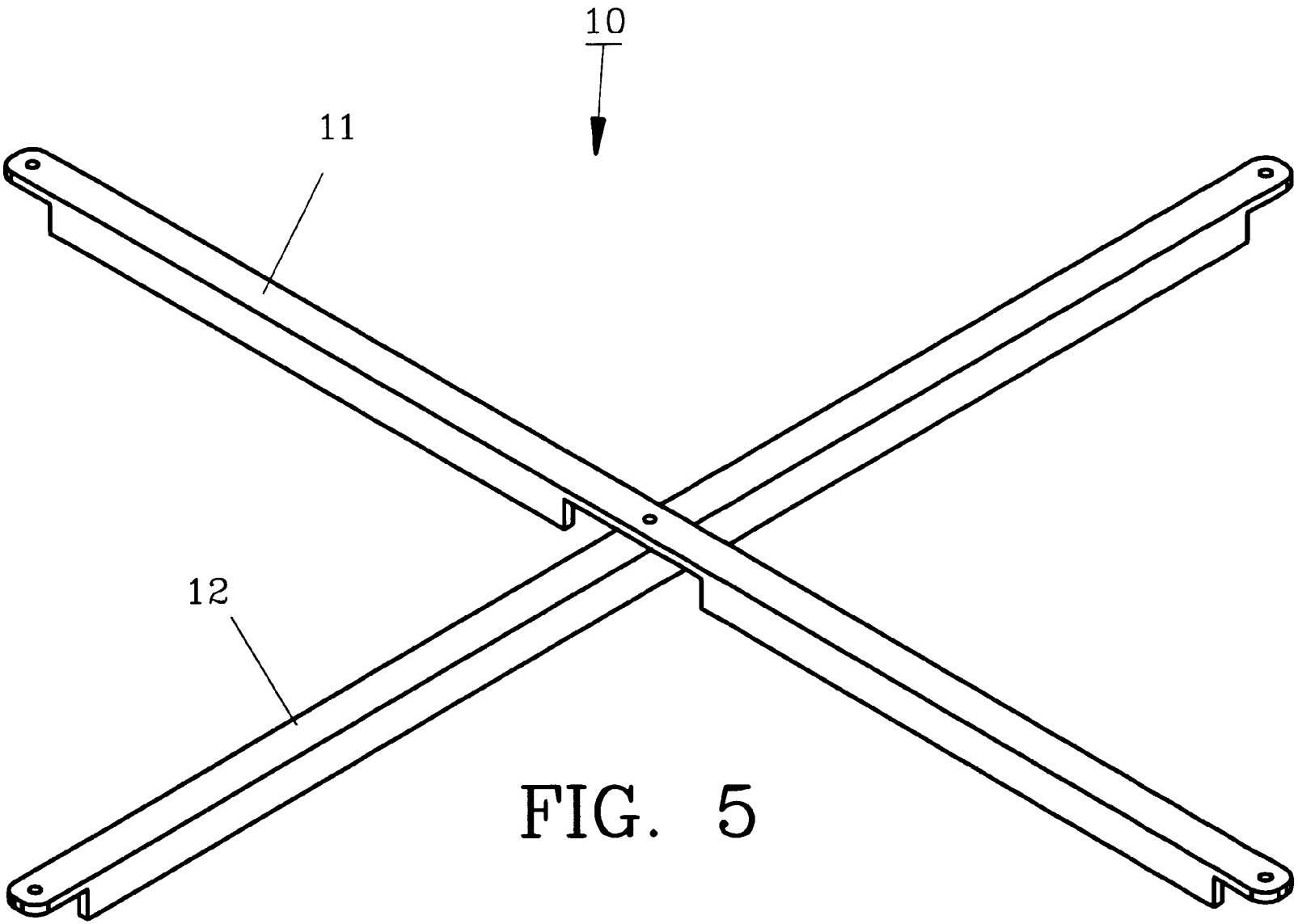
FIG. 5 depicts the device of FIG. 1 removed from the bed frame in a top perspective view.

FIG. 5 demonstrates in perspective fashion, a view of the top of mattress support 10 without leg 38 as seen along the right side thereof. It being understood that the left side would mirror this view.

Figure 6:
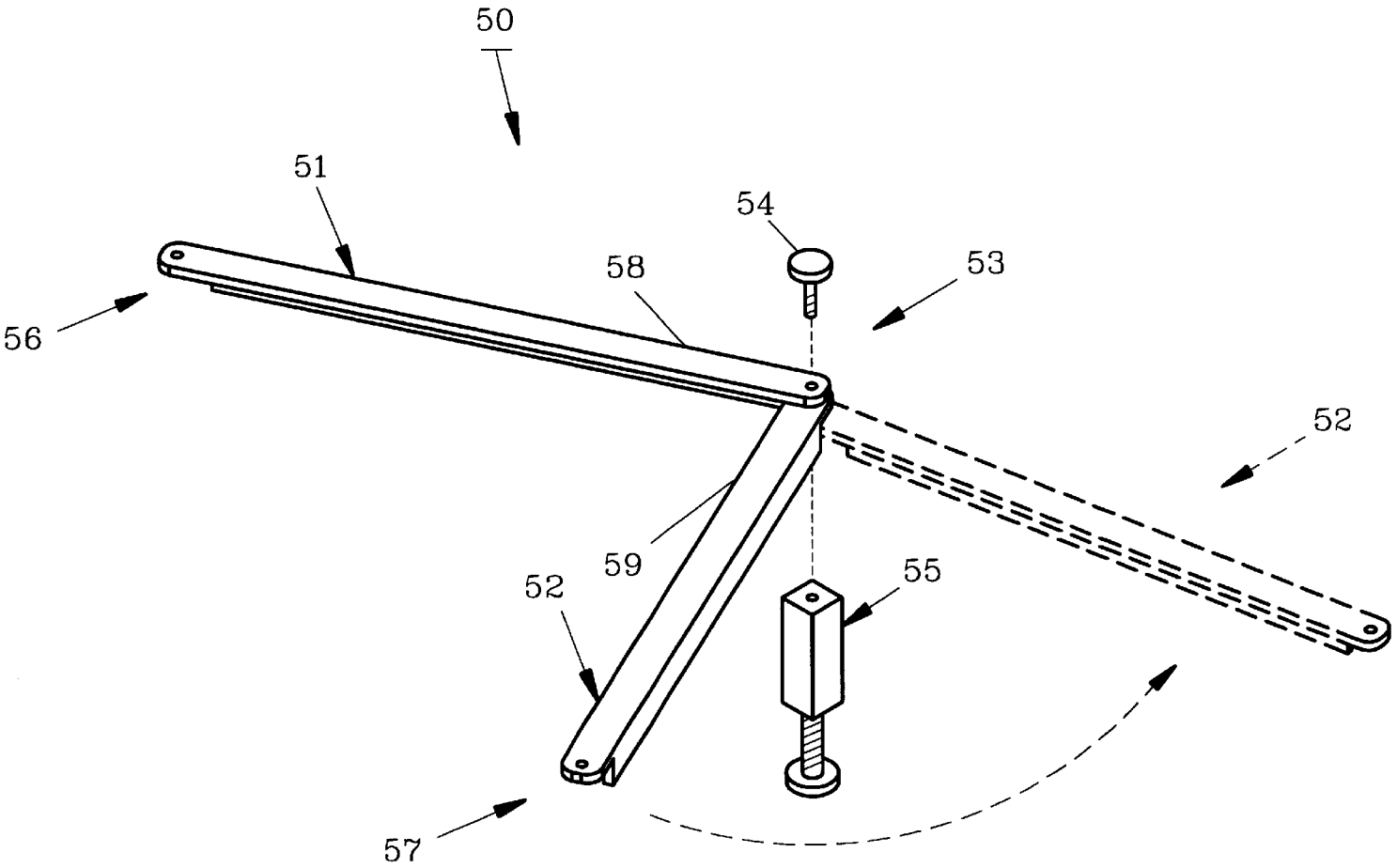
FIG. 6 presents an alternate v-shaped embodiment of the invention partially open, with dashed lines showing a wider opening as would be necessary for a wider bed.

In an alternate embodiment, pivotal v-shaped slat 50 is shown in top perspective view in FIG. 6 having a pair of longitudinal members 51, 52. As would be understood, a top or first longitudinal member 51 and second or bottom longitudinal member 52 are formed of angle iron for rigidity and are joined at intersection 53 by threaded member 54 which connects to a standard adjustable leg 55 (shown in exploded fashion). Longitudinal members 51 and 52 include distal ends respectively, 56, 57 and proximal ends 58, 59. In the method of use, distal ends 56, 57 are mounted to opposing bed rails by screws or other fasteners and one or more slats 50 may be employed, depending on the length of the bed and the rigid support required.

Figure 7:
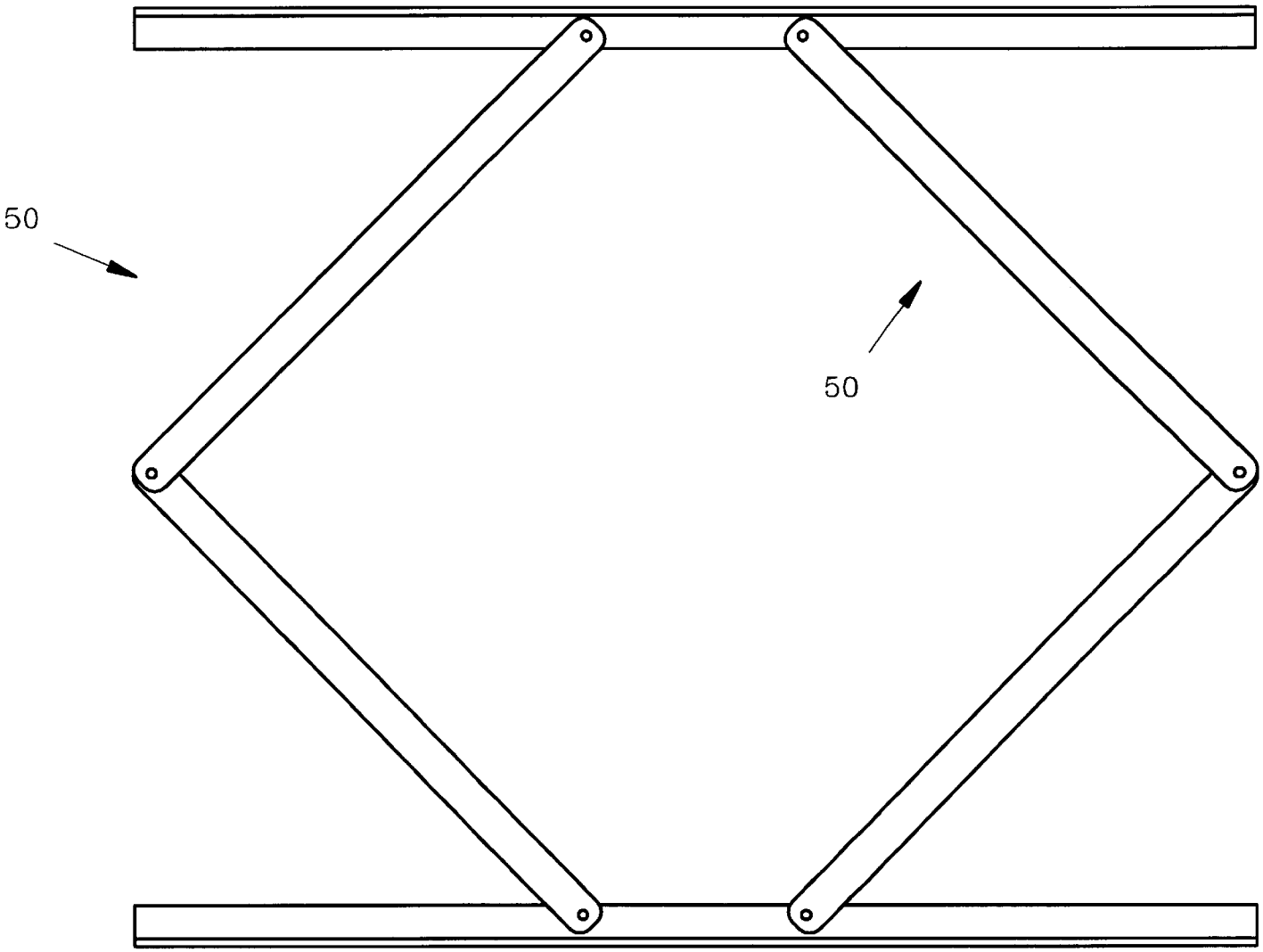
FIG. 7 demonstrates a pair of v-shaped slats as shown in FIG. 6 on a relatively wide bed frame.
Figure 8:
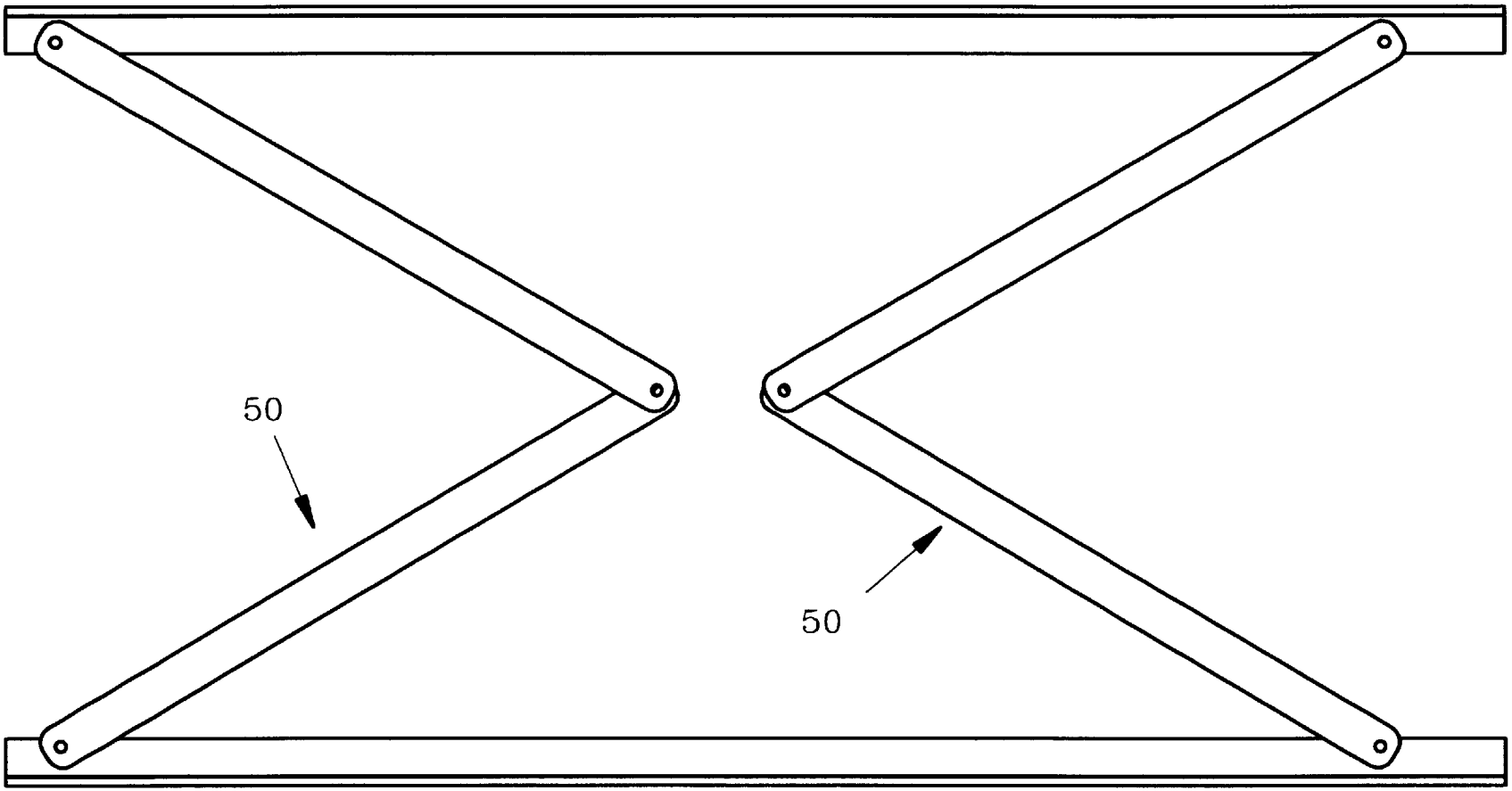
FIG. 8 illustrates a pair of the v-shaped slats on a narrow bed frame.
Figure 9:
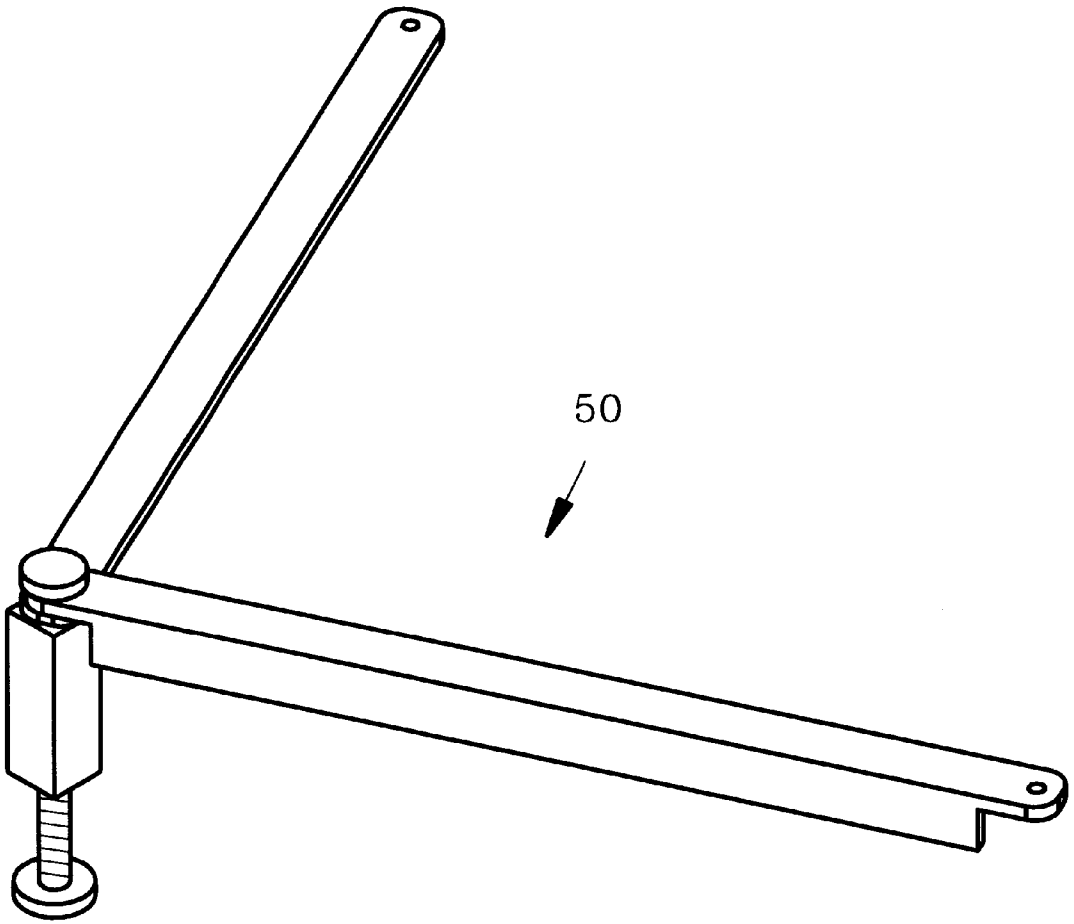
FIG. 9 shows a rear view of the v-shaped slat with the leg attached.
Figure 10:
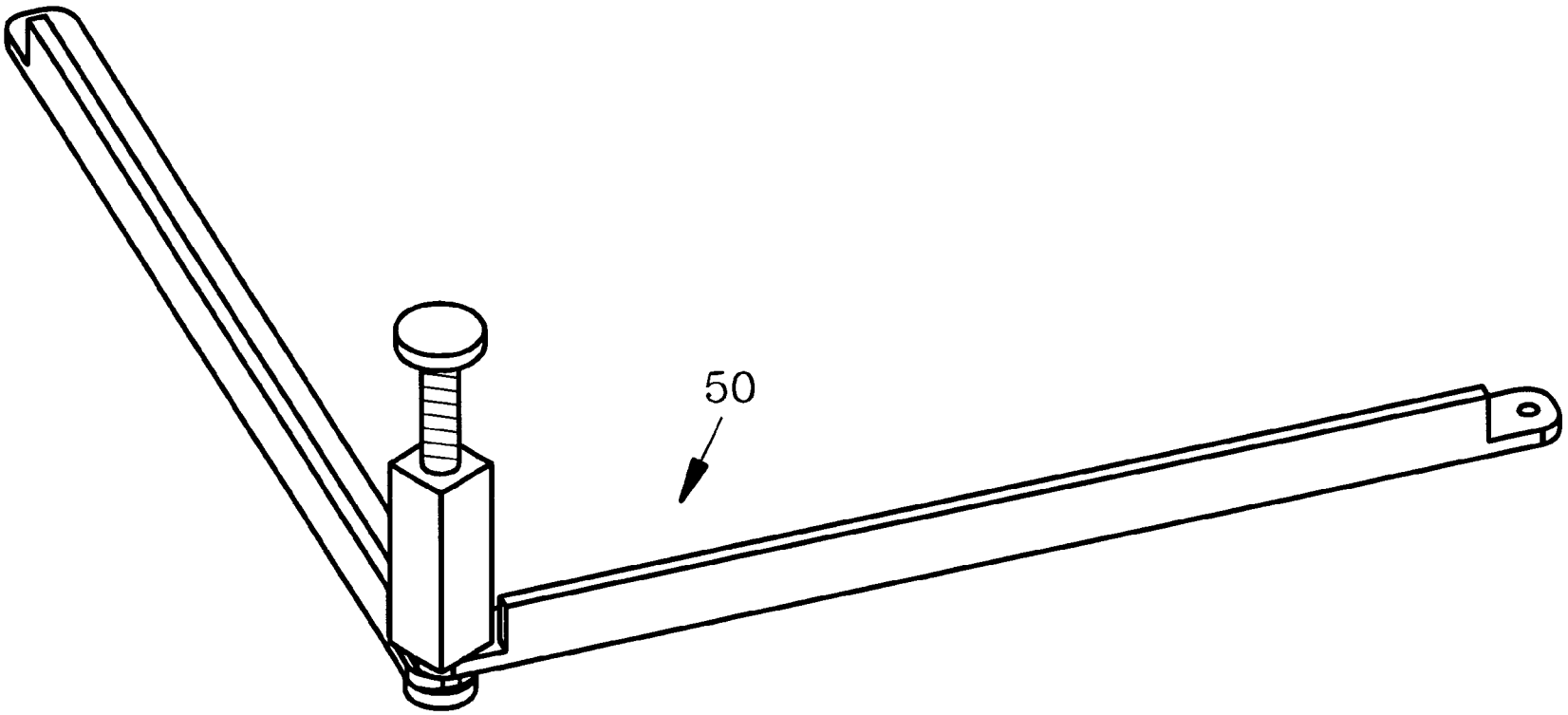
FIG. 10 pictures an inverted view of the v-shaped slat, also with the leg attached.

In FIG. 7, a wide bed frame is shown which may have a width of 198 cm whereas in FIG. 8 a pair of slats 50 are shown in a relatively narrow bed frame perhaps having a width of 90 cm. It is important that the bed frame properly support a mattress and/or box springs and as such a plurality of v-shaped slats 50 can be employed as required. In FIG. 9 a rear view of slat 50 is seen while in FIG. 10 an inverted view is illustrated with an adjustable leg attached.

Leg 55 which is attached to slat 50 is a standard threadably adjustable leg as used in the furniture industry and provides additional support against the floor or other surface on which the bed frame is located. Slat 50 is formed of suitably dimensioned angle iron for strength and rigidity to support mattresses and box springs of various weights and load bearing capacity.

Figure 11:
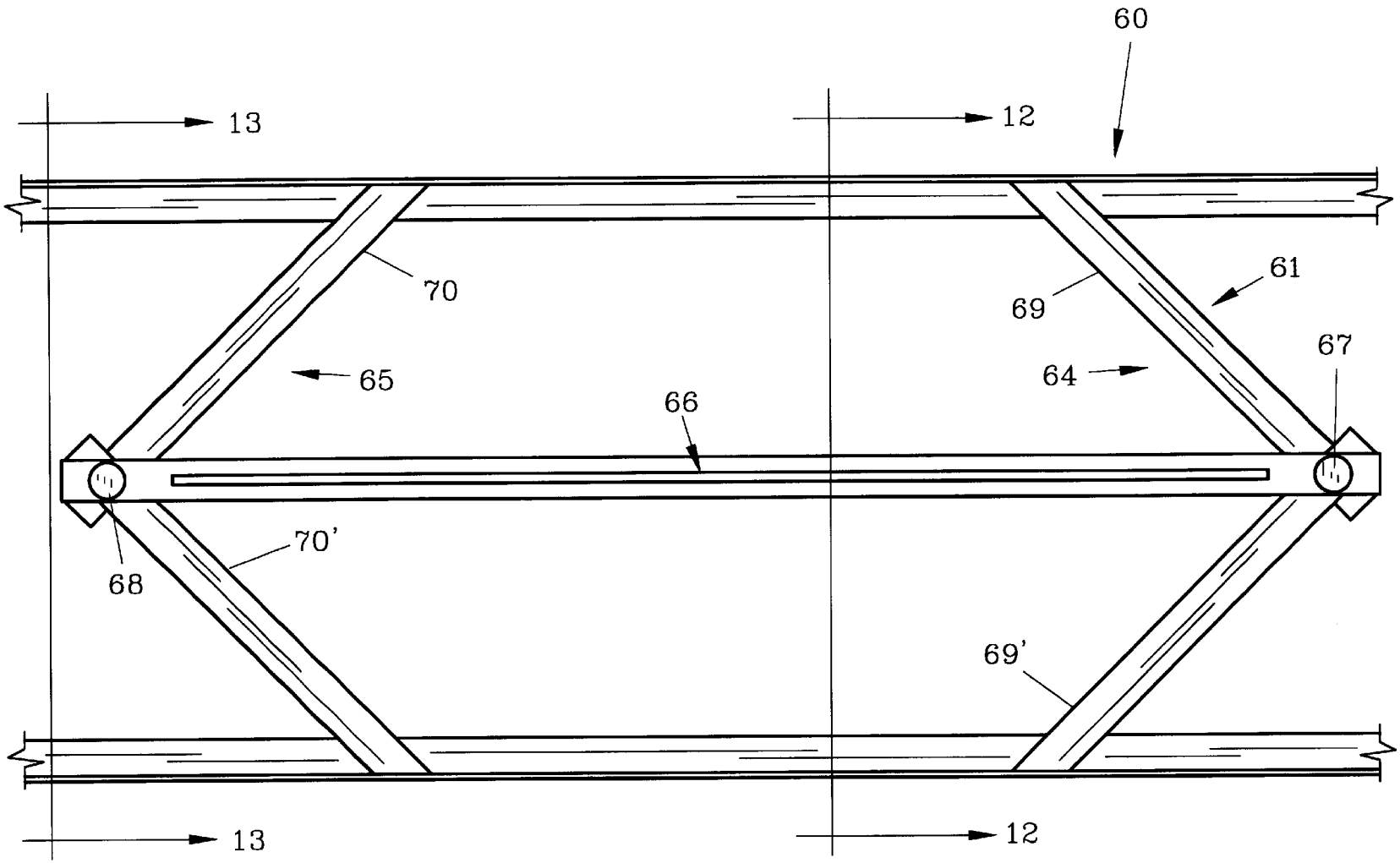
FIG. 11 features yet another embodiment of a mattress support utilizing a pair of v-shaped slats which are connected by a divider having an inverted t-shape when seen in cross section.
Figure 12:
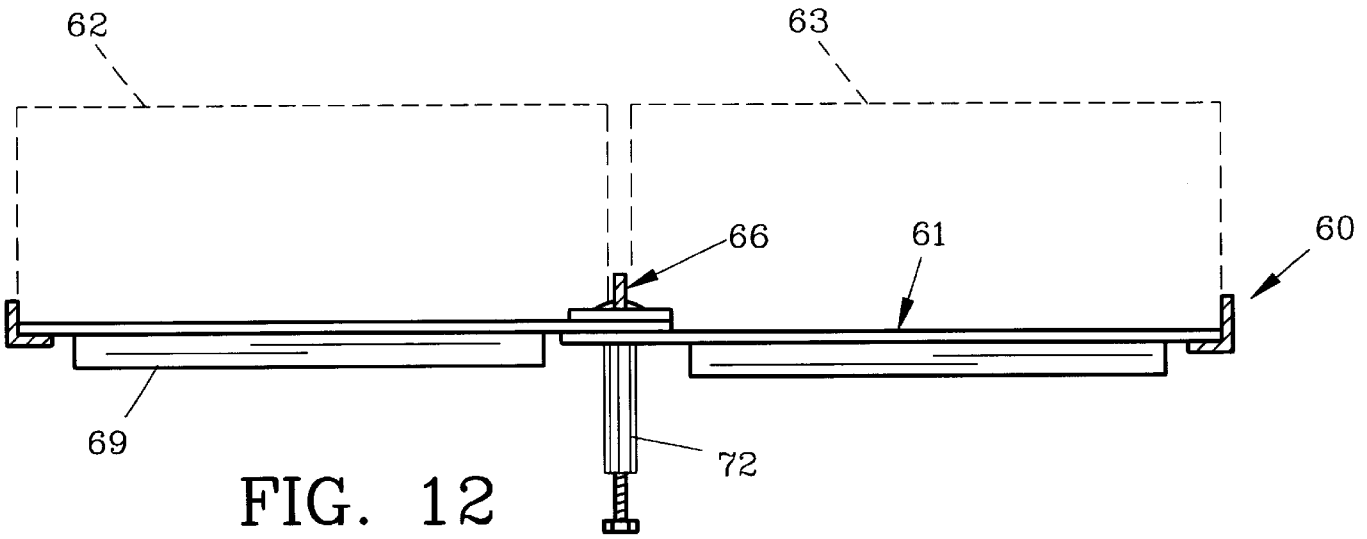
FIG. 12 shows the mattress support of FIG. 11 along lines 12—12 therein.
Figure 13:
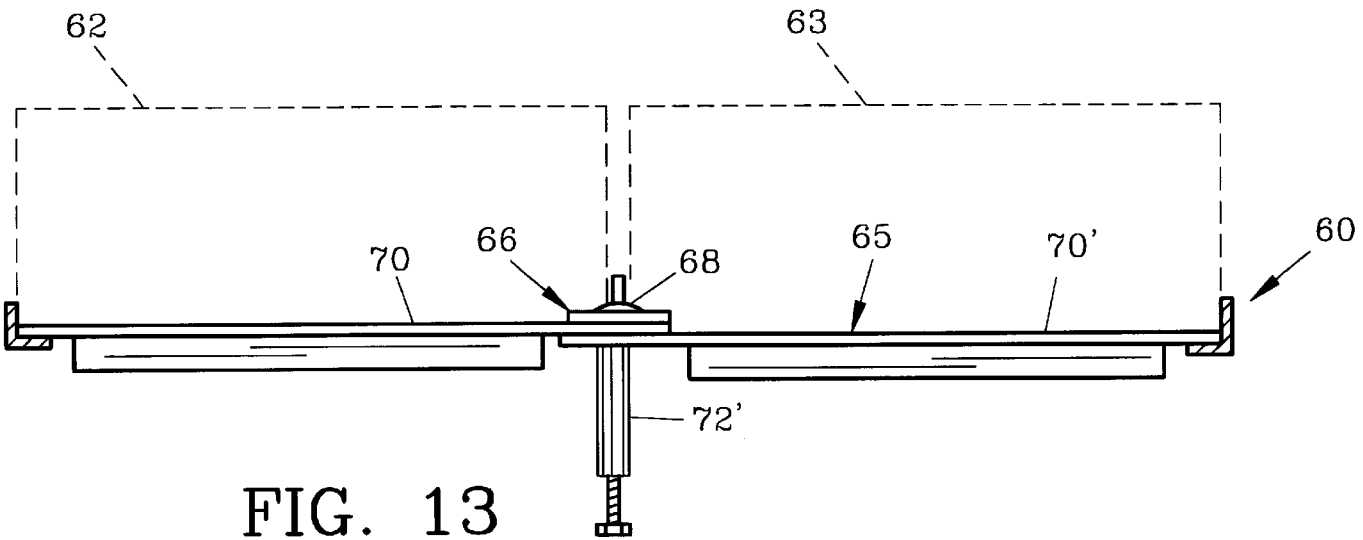
FIG. 13 depicts another view of the embodiment as seen in FIG. 11 along lines 13—13 therein.

In yet another embodiment of the invention as seen in FIG. 11, a wide bed frame 60 is shown in fragmented fashion with mattress support 61 thereon. Mattress support 61 may for example provide support to a pair of mattresses or box springs 62, 63 shown in ghost fashion in FIGS. 12 and 13. Mattress support 61 includes pairs of v-shaped slats 64, 65 which are connected by inverted t-shaped divider 66. Inverted t-shaped divider 66, as shown in cross sectional view in FIG. 12 as along lines 12—12 of FIG. 11, is connected to v-shaped slat 64 by threaded member 67 which passes through apertures (not seen) in V-shaped divider 66 and longitudinal members 69, 69'. Inverted threaded member 68 likewise passes through apertures (not seen) in divider 66, and in longitudinal members 70, 70'. Threaded members 67, 68 are received by rounded legs 72, 72' as hereinbefore described regarding standard leg 55. v-shaped slat 64, 65 can be rotatably adjusted as shown in FIG. 6 for a variety of bed widths. By threadably tightening member 67 into leg 70 through longitudinal members 69, 69' a sturdy mattress support is provided for wide bed frames utilizing a pair of side-by-side mattresses such as seen in FIGS. 12 and 13.

The preceding recitation is provided as an example of the preferred and alternate embodiments and is not meant to limit the nature of scope of the present invention or appended claims. As would be understood, angle iron is used due to its rigid nature as is needed here for relatively long spans to insure safety and comfort for the user.

I claim:

1. A mattress support comprising: a pair of V-shaped slats when seen in plan view, each of said V-shaped slats comprising a pair of longitudinal members, a center divider, said center divider having an inverted t-shape when viewed in cross section, said V-shaped slats attached to opposite ends of said center divider.

2. The mattress support of claim 1 further comprising a first adjustable leg, said leg attached to one of said V-shaped slats.

3. The mattress support of claim 2 further comprising a second adjustable leg, said second adjustable leg attached to the other of said V-shaped slats.

4. The mattress support of claim 1 wherein each of said longitudinal members is rotatably adjustable.

5. The mattress support of claim 1 in combination with a pair of mattresses, said mattresses aligned side-by-side with said center divider therebetween.

* * * * *